US007699647B2

(12) United States Patent
Sun

(10) Patent No.: US 7,699,647 B2
(45) Date of Patent: Apr. 20, 2010

(54) USB CONNECTOR

(75) Inventor: Zheng-Heng Sun, Taipei Hsien (TW)

(73) Assignee: Hon Hai Precision Industry Co., Ltd., Tu-Cheng, Taipei Hsien (TW)

( * ) Notice: Subject to any disclaimer, the term of this patent is extended or adjusted under 35 U.S.C. 154(b) by 0 days.

(21) Appl. No.: 12/182,117

(22) Filed: Jul. 29, 2008

(65) Prior Publication Data

US 2009/0280662 A1 Nov. 12, 2009

(30) Foreign Application Priority Data

May 9, 2008 (CN) ..... 2008 1 0301528

(51) Int. Cl.
*H01R 13/66* (2006.01)
*H01R 13/60* (2006.01)

(52) U.S. Cl. ..... 439/541.5

(58) Field of Classification Search ..... 439/541.5, 439/78

See application file for complete search history.

(56) References Cited

U.S. PATENT DOCUMENTS 6,120,321 A * 9/2000 Wu ..... 439/541.5
7,124,215 B2 * 10/2006 Lelong et al. ..... 710/62

* cited by examiner

*Primary Examiner*—Javaid Nasri
(74) *Attorney, Agent, or Firm*—Zhigang Ma

(57) ABSTRACT

A universal serial bus (USB) connector includes a first sidewall defining at least one external USB socket for connecting to an external USB device of a host computer. A second sidewall defining at least one internal USB socket for connecting to an internal USB device of the host computer. A plurality of signal pins are connected to a motherboard of the host computer, and capable of connecting the at least one external USB device and the at least one internal USB device with the motherboard.

6 Claims, 4 Drawing Sheets

USB CONNECTOR

BACKGROUND

1. Field of the Invention

The present invention relates to connectors, and particularly to a universal serial bus (USB) connector.

2. Description of Related Art

With advances in computer technology, peripheral devices using USB connectors have become more and more popular. Even some electronic devices inside the host computer use USB connectors. FIG. 4 shows two USB sockets 200 arranged side-by-side on a conventional motherboard 100. Internal peripheral devices, such as built-in card-readers, CD-ROMs, etc., are connected to the USB sockets 200 via USB connectors 300.

However, when many internal USB devices using USB connectors are connected to the motherboard, more USB sockets are needed and occupy too much space of the motherboard.

What is needed, therefore, is a USB connector which can solve the above-mentioned problem.

DETAILED DESCRIPTION

Figure 1:
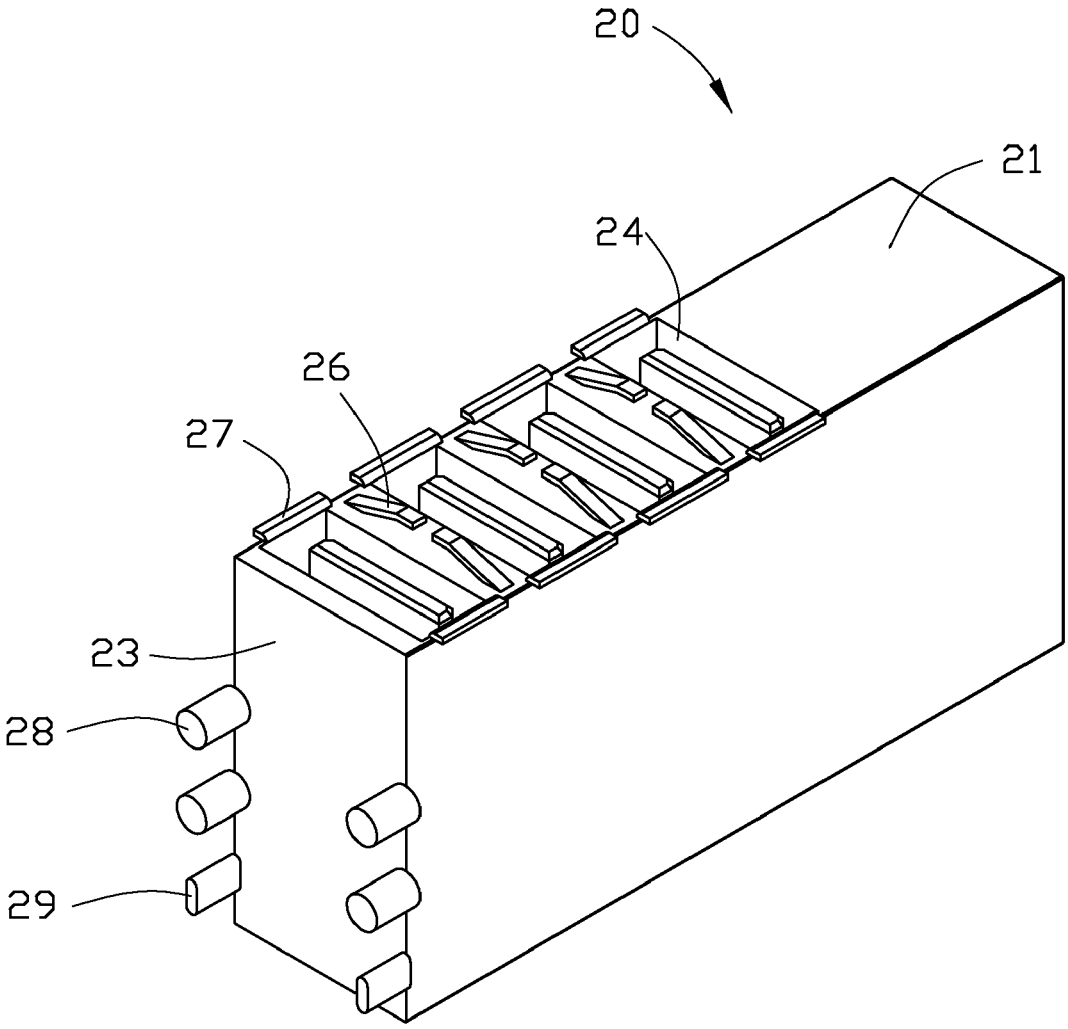
FIG. 1 is an isometric view of a USB connector in accordance with an embodiment of the present invention.
Figure 2:
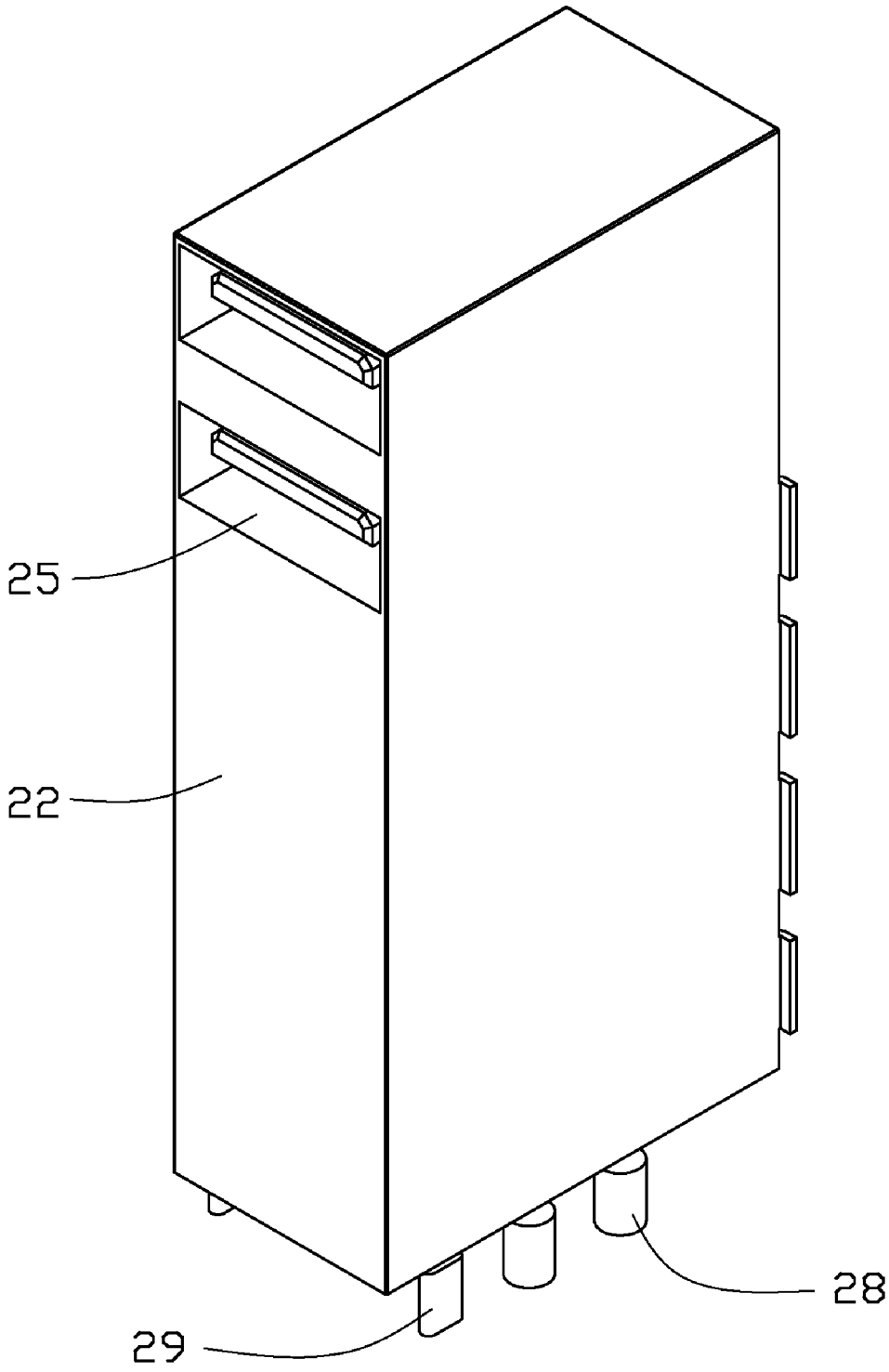
FIG. 2 is similar to FIG. 2, but viewed from another aspect.
Figure 3:
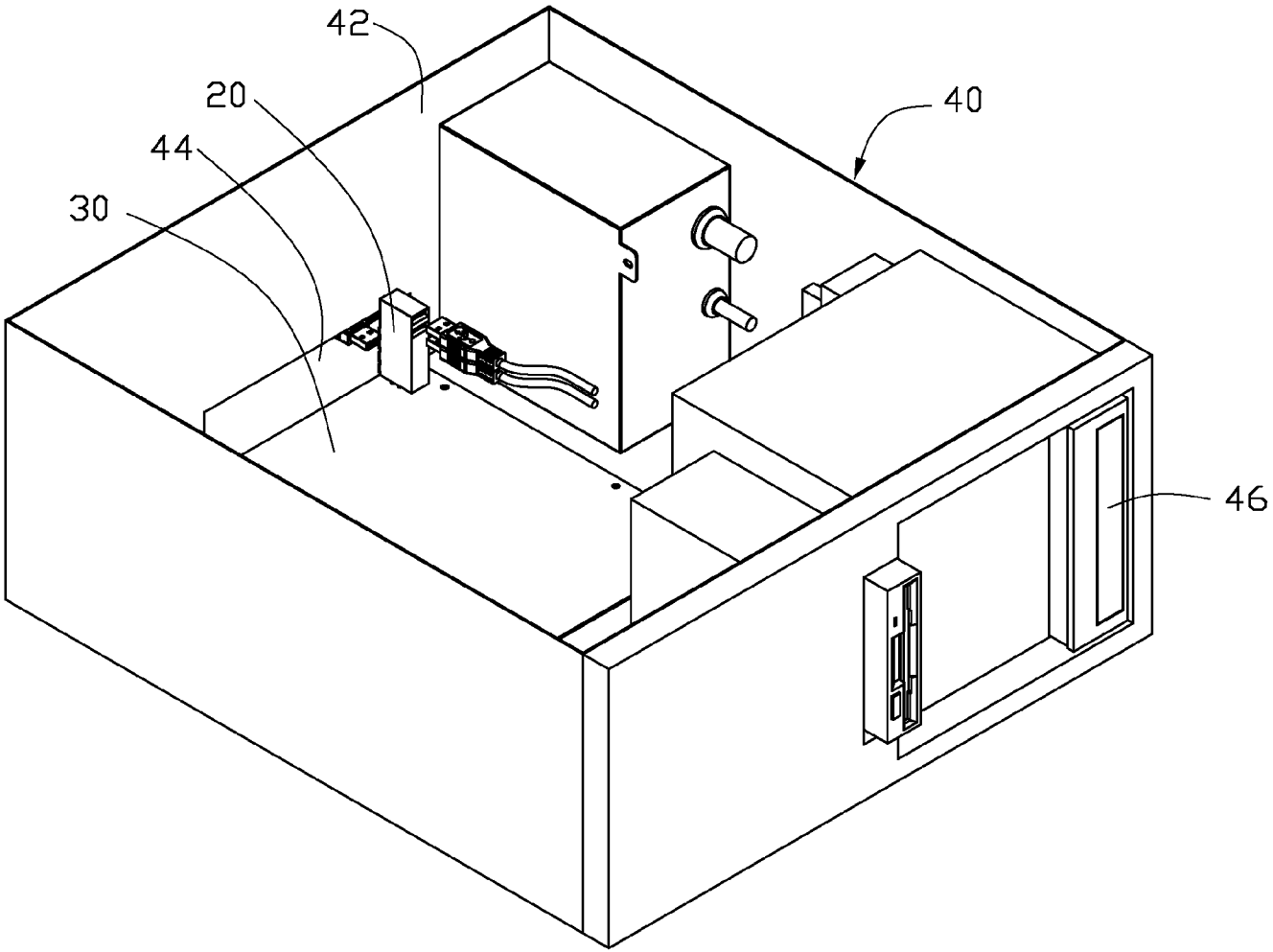
FIG. 3 is an perspective view of the USB connector of FIG. 2 used in a computer enclosure.

Referring to FIGS. 1, 2 and 3, a USB connector 20 in accordance with an exemplary embodiment of the present invention is cuboid-shaped. The USB connector 20 includes a sidewall 21 defining four external USB sockets 24, another sidewall 22 defining two internal USB sockets 25, four signal pins 28, and two fixing posts 29. The external USB sockets 24 are used for connecting to external USB devices (not shown) of a host computer 40. The internal USB sockets 25 are used for connecting to internal USB devices such as a CD-ROM 46 of the host computer 40. The signal pins 28 and the fixing posts 29 protrude from a bottom end wall 23 of the USB connector 20. The internal USB sockets 25 and the external USB sockets 24 can communicate with a motherboard 30 of the host computer 40 via the signal pins 28. The USB connector 20 is fixed on the motherboard 30 of the host computer 40 via the fixing posts 29. The fixing posts 29 can be replaced by other fixing devices according to need. The number of the external USB sockets 24, the internal USB sockets 25, the signal pins 28, and the fixing posts 29 can be adjusted according to need.

In this embodiment, the external USB sockets 24 and the internal USB sockets 25 are parallel to each other. The signal pins 28 and the fixing posts 29 are aligned in two rows with each row including two signal pins 28 and one fixing post 29 set on one side edge of the bottom end wall 23.

The two sidewalls 21 and 22 are opposite to each other. The sidewall 21 faces a panel 42 of the host computer 40 and is exposed from an opening 44 of the panel 42 to outside. Two bent tabs 27 are extended from two opposite side edges of each of the external USB sockets 24. The bent tabs 27 contact the panel 42 of the host computer 40 for releasing static electricity. An elastic projecting portion 26 is set on the sidewall 21 between every two adjacent external USB sockets 24. The elastic projecting portions 26 also contact the panel 42 of the host computer 40 for releasing static electricity. Every two adjacent external USB sockets 24 are preferably, but not necessarily, equally spaced along the longitudinal direction of the one sidewall 21.

Figure 4:
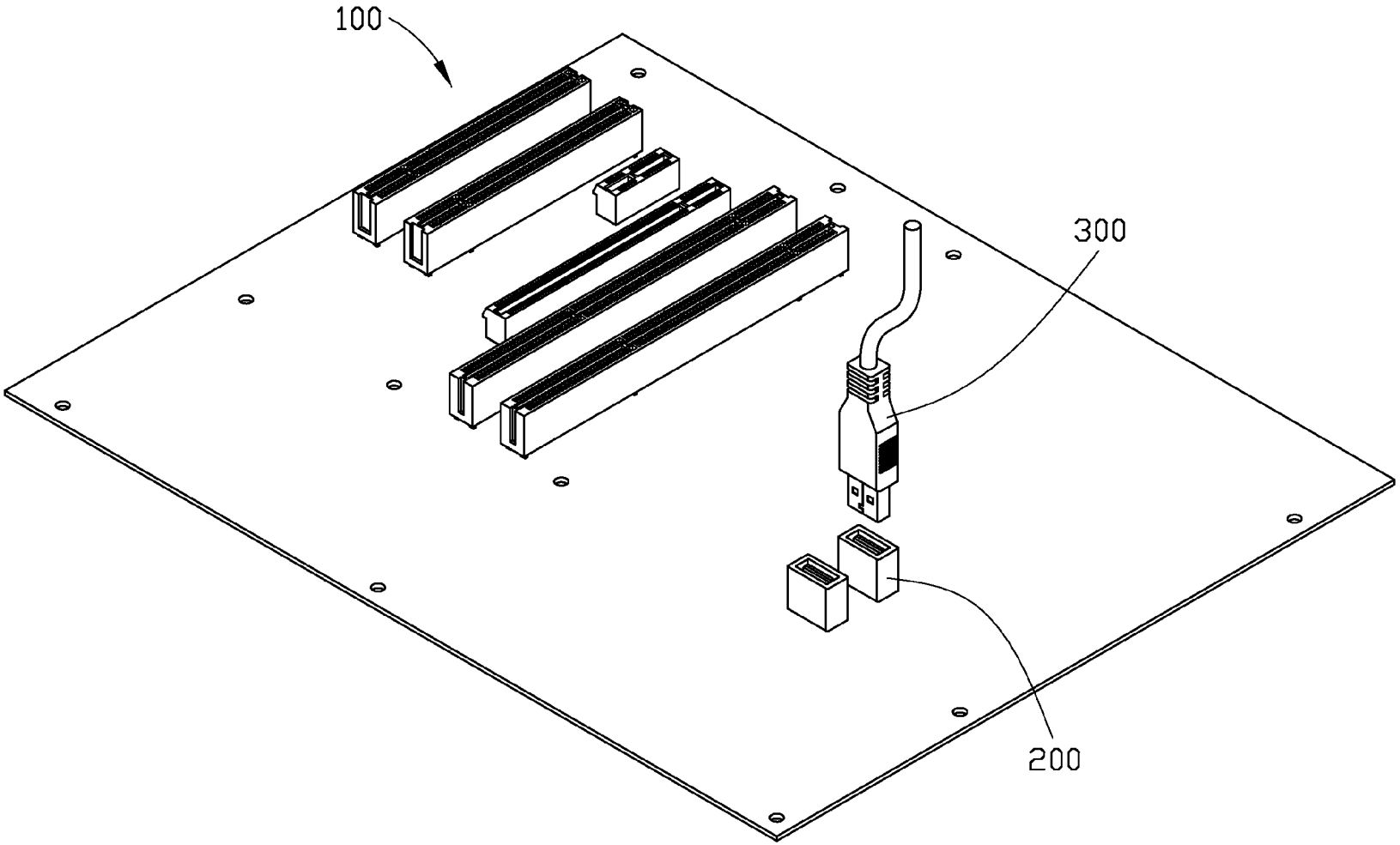
FIG. 4 (PRIOR ART)
FIG. 4 is a schematic, isometric diagram of conventional USB sockets on a conventional motherboard.

The USB connector 20 includes the external USB sockets 24 for connecting external USB devices and the internal USB sockets 25 for connecting internal USB devices of the host computer 40. The motherboard 30 having the USB connector 20 can save spaces comparing with the conventional motherboard 100 of FIG. 4.

The shape of the USB connector 20 can be selected according to need. The internal USB sockets 25 can also be set on other external input/output (I/O) connectors of the host computer 40.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A universal serial bus (USB) connector comprising:

a first sidewall defining at least one external USB socket for connecting to an external USB device of a host computer;

a second sidewall opposite to the first sidewall, and defining at least one internal USB socket for connecting to an internal USB device of the host computer; and a bottom end wall connecting the first and second sidewalls, seated on a motherboard of the host computer, and defining a plurality of signal pins connected to the motherboard of the host computer, and capable of connecting the at least one external USB device and the at least one internal USB device with the motherboard;

wherein the first sidewall abuts a panel of the host computer, the panel defines an opening therein, the at least one external USB socket in the first sidewall is exposed to the outside of the computer through the opening.

2. The USB connector as claimed in claim 1, wherein the USB connector is cuboid-shaped confined by the first and second sidewalls, another two opposite sidewalls, the bottom end wall, and a top end wall.

3. The USB connector as claimed in claim 1, wherein two bent tabs are extended from two side edges of the at least one external USB socket for contacting the panel of the host computer to release static electricity.

4. The USB connector as claimed in claim 1, wherein the at least one external USB socket is a plurality of the external USB sockets, a projecting portion is set on the one sidewall between every two adjacent external USB sockets for contacting the panel of the host computer to release static electricity.

5. The USB connector as claimed in claim 1, further comprising at least one fixing post for fixing the USB connector on the motherboard of the host computer.

6. The USB connector as claimed in claim 5, wherein the signal pins and the at least one fixing post protrude from the bottom end wall of the USB connector.

* * * * *